United States Patent [19]

Shirley

[11] 4,083,405

[45] Apr. 11, 1978

[54] WELL DRILLING METHOD AND APPARATUS THEREFOR

[75] Inventor: Kirk R. Shirley, Houston, Tex.

[73] Assignee: A-Z International Tool Company, Houston, Tex.

[21] Appl. No.: 763,127

[22] Filed: Jan. 27, 1977

Related U.S. Application Data

[63] Continuation of Ser. No. 683,650, May 6, 1976, abandoned.

[51] Int. Cl.[2] ..... E21B 23/00; E21B 33/126; E21B 33/129; E21C 17/00

[52] U.S. Cl. ..... 166/285; 166/123; 166/138; 166/129; 166/140; 166/315; 175/65; 175/230; 175/284

[58] Field of Search ..... 166/285, 315, 290, 216, 166/217, .5, 123, 138, 129, 140; 175/65, 57, 325, 285, 284, 230

[56] References Cited

U.S. PATENT DOCUMENTS

| | | | |
|---|---|---|---|
| 2,641,444 | 6/1953 | Moon | 166/315 |
| 2,644,523 | 7/1953 | Brown | 166/285 |
| 2,802,534 | 8/1957 | Conrad | 166/138 |
| 2,929,610 | 3/1960 | Stratton | 166/315 X |
| 3,195,646 | 7/1965 | Brown | 166/216 X |
| 3,314,478 | 4/1967 | Burns | 166/315 |
| 3,570,599 | 3/1971 | Wilson et al. | 166/216 X |
| 3,741,304 | 6/1973 | McGill | 166/216 |

*Primary Examiner*—Stephen J. Novosad
*Attorney, Agent, or Firm*—Vinson & Elkins

[57] ABSTRACT

The method and apparatus for drilling a well bore and setting a liner therein in which the drill string with a bit and underreamers thereon also includes a liner supported thereon which has a gripping assembly with two sets of gripping elements and a pair of external tapers on the liner each of which coacts with one of the sets of gripping elements, one of which wedges one set of gripping elements into set position responsive to the liner weight and the other of which is spaced from said one a sufficient distance that said one is removed from wedging engagement when said other wedges the other set of gripping elements into set position responsive to upward forces on said liner, and a normally closed bypass around the sealing means on the liner which may be opened responsive to manipulation of the liner to allow cementing of the liner in position within the well bore and the steps of lowering the liner on the drill string as the well bore is being formed, setting the liner, gripping assembly and sealing means, opening the bypass around the liner sealing means and cementing the lever in the well bore.

9 Claims, 20 Drawing Figures

122
126
132
130
128
130
138
138
6
7
142
148
152
150
146
140
144
154
128
156
138
14
6
7

WELL DRILLING METHOD AND APPARATUS THEREFOR

CROSS-REFERENCE TO RELATED APPLICATION

The present application is a continuation application of my prior copending application Ser. No. 683,650, filed May 6, 1976, now abandoned.

BACKGROUND OF THE INVENTION

In drilling wells, the passage of the drill string through highly porous gas formations causes considerable difficulty since the liquid, such as mud, in the well which can prevent a blowout can rapidly flow into the formation and the gas from the formation enters the well bore with limited prospects of immediately controlling the gas and continuing drilling into a lower oil formation.

SUMMARY

The present invention provides an improved method of any apparatus for drilling a well to minimize the danger of a gas blowout and allow control of the gas whenever a porous formation having gas is encountered by the drill string.

The method includes the steps of supporting a liner on the drill string during drilling which has external seals for sealing against the casting in the well bore. Further steps include supporting the liner, retrieving the drill string, running a cementing string, cementing the annulus around the liner and retrieving the cementing string.

BRIEF DESCRIPTION OF THE DRAWINGS

These and other objects and advantages of the improved method and apparatus of the present invention are hereinafter set forth with reference to the drawings wherein.

Figure 1A:
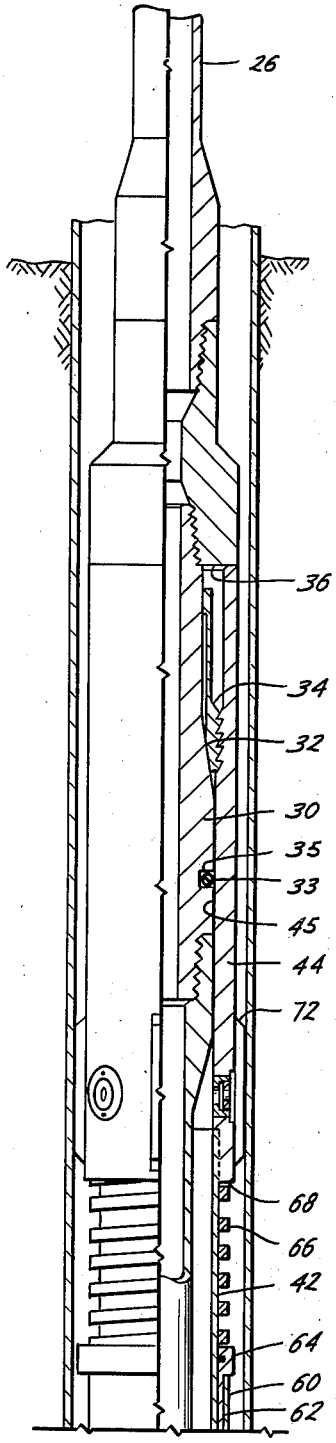
FIG. 1 (including FIGS. 1A, 1B, 1C, 1D and 1E) is a sectional view of the improved well tool of the present invention being used in drilling a well bore with a liner supported on the string.
Figure 2A:
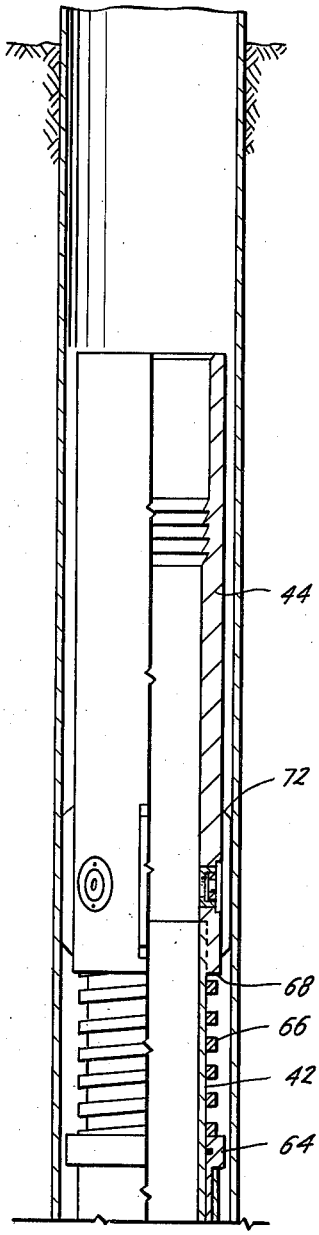
FIG. 2 (including FIGS. 2A, 2B, 2C and 2D) is a similar view illustrating the liner supported in the well bore with the drill string removed.
Figure 3A:
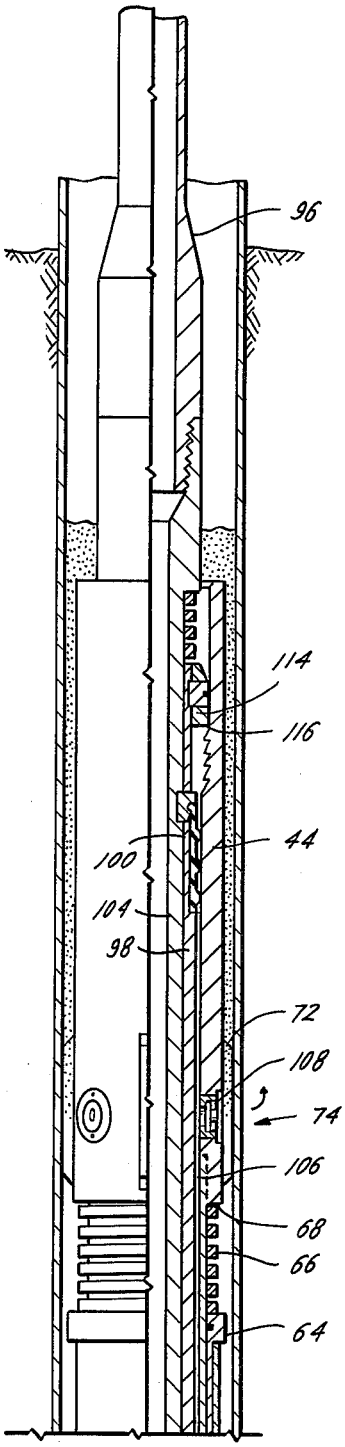
FIG. 3 (including FIGS. 3A, 3B, 3C and 3D) is another similar view illustrating the cementing of the liner.
Figure 1B:
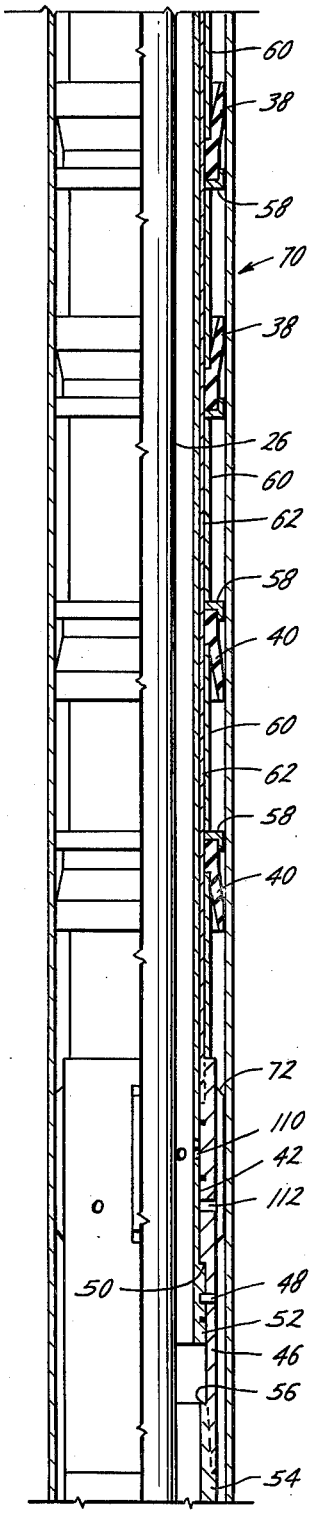
Figure 2B:
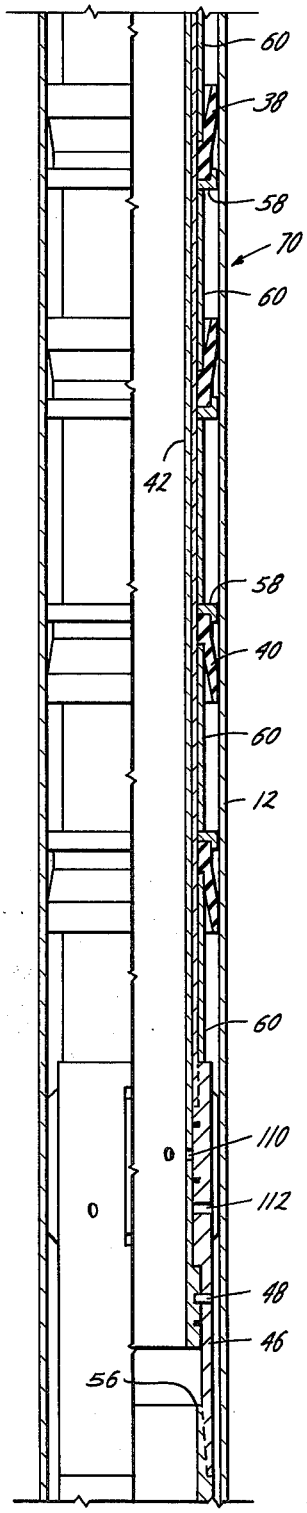
Figure 3B:
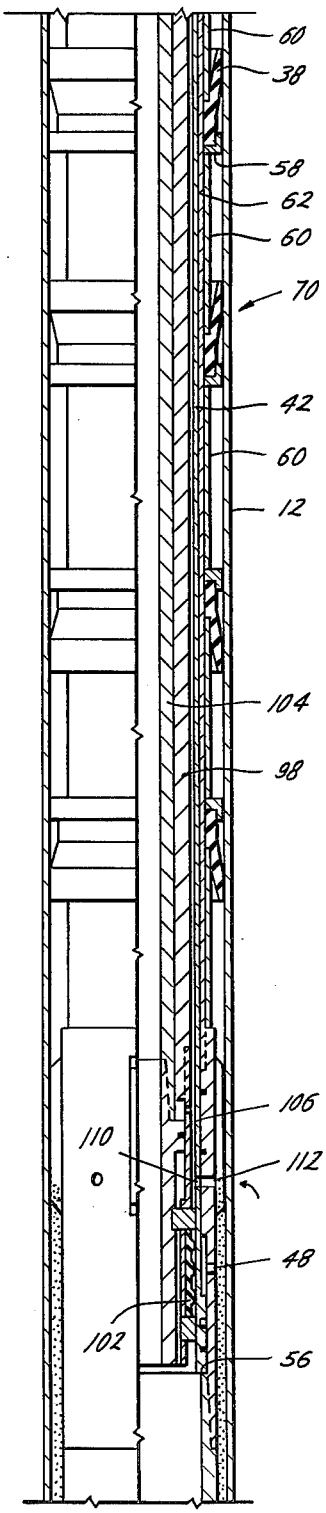

In those drawings having multiple portions, the A portion of the drawing illustrates the upper section of the tool and subsequent portions of the drawing illustrate the progressively lower sections of the well tool.

DESCRIPTION OF THE PREFERRED EMBODIMENT

Figure 4A:
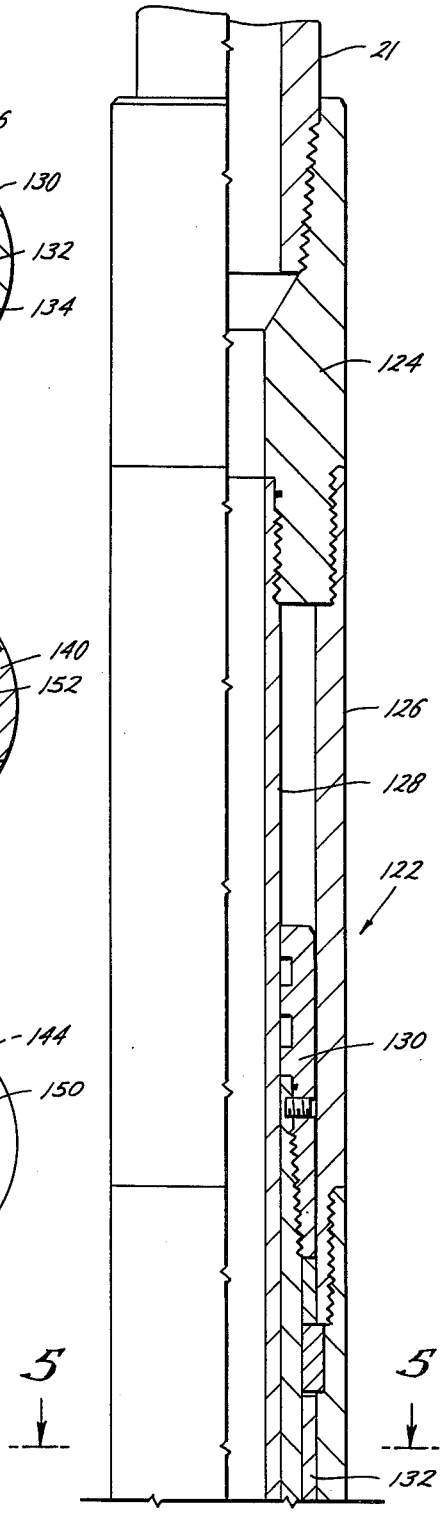
FIG. 4 (including FIGS. 4A, 4B, 4C and 4D) is a partial sectional view of the drilling apparatus of the drill string.

The improved well tool of the present invention is shown in FIG. 1 in a well bore 10 lined with the casing 12 and drilling downwardly to extend the depth of the well bore 10 below the lower end of casing 12. The drilling apparatus on the lower end of the well tool, as shown in FIG. 1E, includes the drill bit 14, the first underreamer 16, the second underreamer 18 and the third underreamer 20. All of said underreamers are expansible so that they progressively expand the well bore diameter to its desired maximum diameter. The details of the underreamers are shown in FIG. 4 and are hereinafter described in relation thereto. Suitable means, such as mud motor 21, is provided to rotate the drilling apparatus.

Drill collars 22 are connected above the third underreamer 20. The stabilizer 24 is connected to the drill collars 22. The drill string 26 is connected above the drill collars 22 and the stabilizer 24 and extends to the drilling rig (not shown). The liner 28 is supported from the drill string 26 as best shown in FIG. 1A. The section 30 of the drill string 26 has an exterior surface 32 which tapers downward and outward to coact with the threaded collet 34 to support the liner 28 from the drill string 26 during the running of the apparatus into the well bore and during drilling. The seal 33 is positioned within the groove 35 in the exterior cylindrical portion of section 30 to provide a seal as hereinafter explained.

Release of the support between the drill string 26 and the liner may be accomplished by right-hand rotation of the drill string 26 which causes the threads on collet 34 to be unthreaded from the mating threads on the interior of liner 28. The connection between the drill string 26 and the liner 28 is made up by lowering the drill string through the liner 28. When the collet 34 engages the threads on the liner 28, the shoulder 36 on drill string 26 engages the upper end of collet 34 and forces collet 34 into mating engagement with the liner threads. With the liner 28 supported on the drill string 26, their running and the subsequent drilling may proceed. The use of the releasable connection allows the drill string, drill collars, mud motor, drill bit and underreamers to be pulled with the liner 28 remaining within the well bore 10 to replace the cutters. Thereafter, the drill string 26 and drilling apparatus may be run through the liner 28 and the collet 34 is forced into secured position so that the liner 28 may again be supported from the drill string 26 after it is released from its support in the well bore.

Since a prime function of the liner 28 is to assist in the controlling of a potential gas blowout, the upper exterior of the liner 28 includes the upward facing sealing cups 38 and the downward facing sealing cups 40. To support the sealing cups 38 and 40, the liner 28 includes the inner tubular member 42 which is threadedly connected to the upper liner mandrel 44 and is secured at its lower end to the liner collar 46 by the shear pin 48. The seal 33 engages the polished bore 45 of upper liner mandrel 44 to provide a seal there between. The downward facing shoulder 50 on the interior of collar 46 is in engagement with the enlargement 52 on the lower end of tubular member 42. The liner section 54 conects to the collar 46 and provides the upward facing shoulder 56 which limits the relative movement between the member 42 and the collar 46 when pin 48 is sheared as hereinafter explained. The sealing cups 38 and 40 each have a support ring 58 and spacer tubes 60 spacing them along the sealing support tube 62. The lower end of support tube 62 is secured to collar 46 and the upper end includes the flange 64 which retains the upper end of the upper spacer tube 60. The spring 66 surrounds tubular member 42 and engages between shoulder 68 on mandrel 44 and the upper surface of flange 64 to maintain the sealing cup assembly 70 in its position with the sealing cups 38 and 40 in sealing engagement with the interior of casing 12. The centralizer 72 is provided with the sealing cup assembly 70 to hold it in a central position within the casing 12 to assure proper sealing of the sealing cups 38 and 40.

As mentioned above, it is desired that the liner 28 be capable of supporting itself within the casing 12 so it includes the hanger assembly 74. Such hanger assembly 74 includes the body 76 having upper gripping elements 78 and lower gripping elements 80 supported on the body 76 and extending upward and downward therefrom, respectively. The drag springs 82 are supported on the body 76 and are adapted to engage the interior of the casing 12 so that when desired the liner 28 may move axially through the body 76.

Figure 1C:
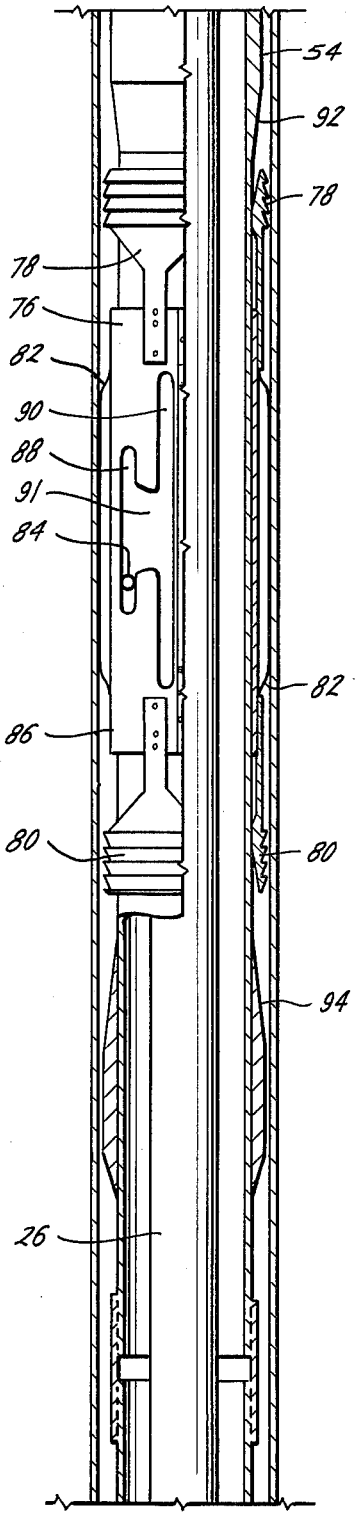
Figure 2C:
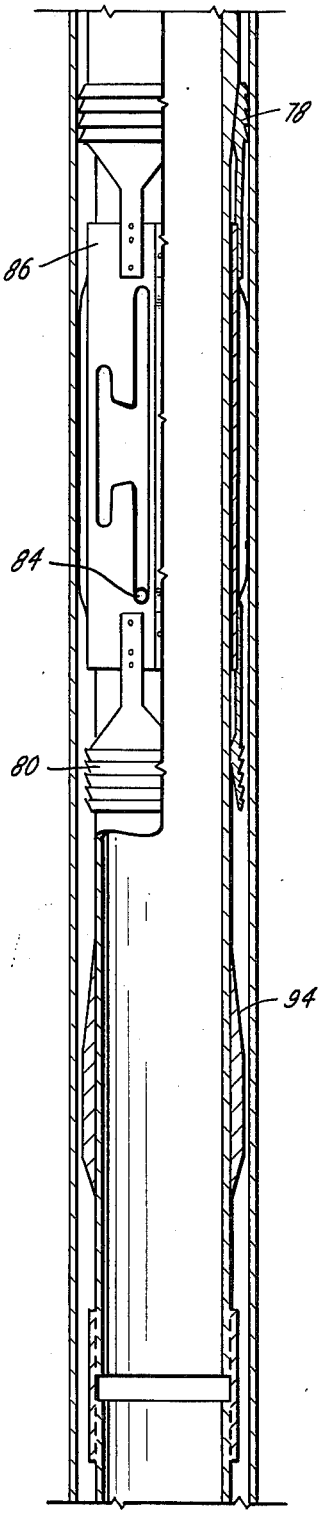
Figure 3C:
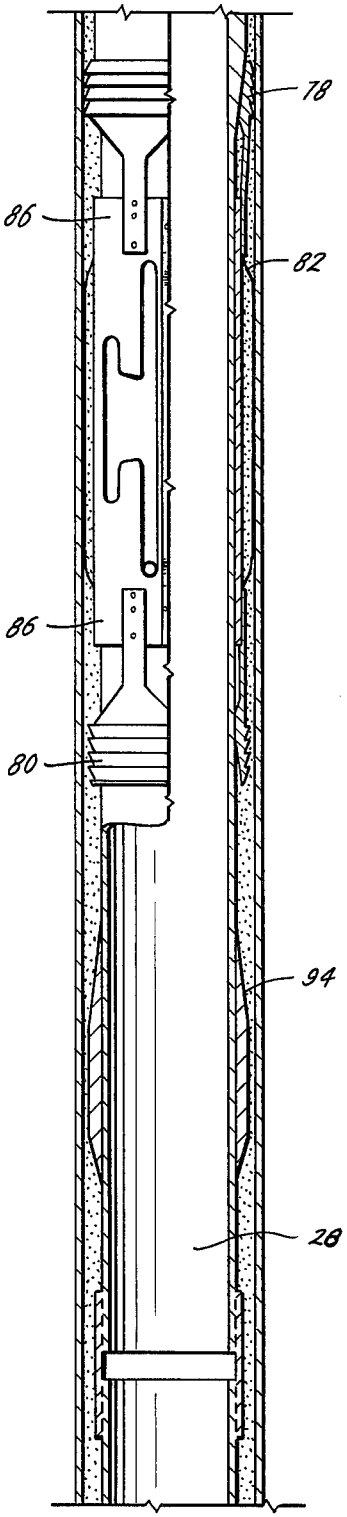
Figure 1D:
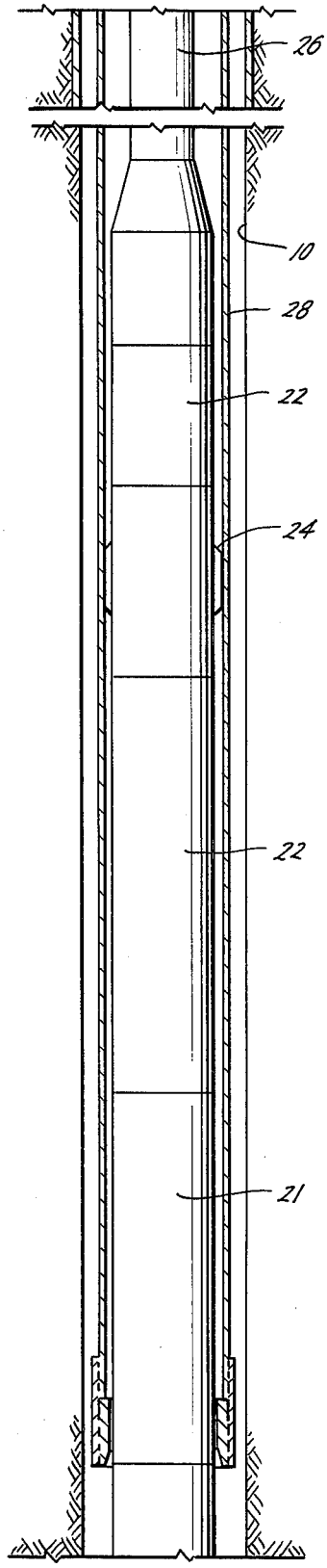
Figure 2D:
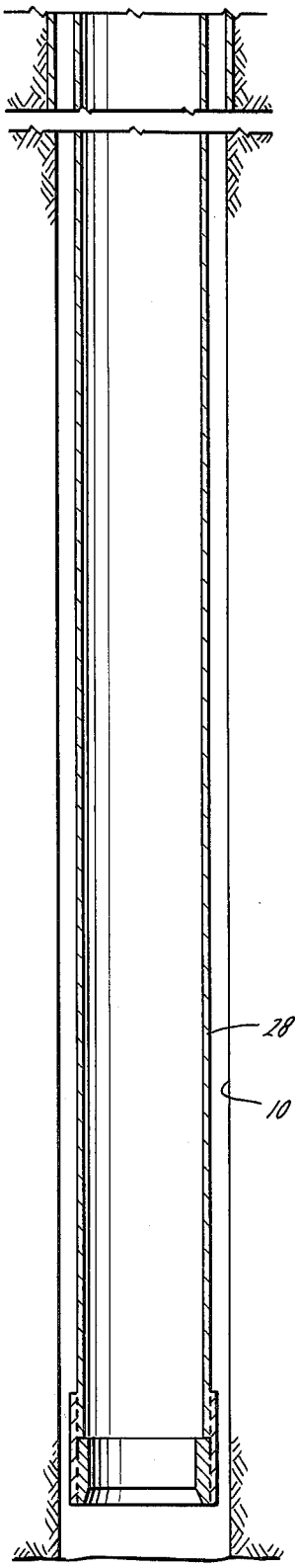
Figure 3D:
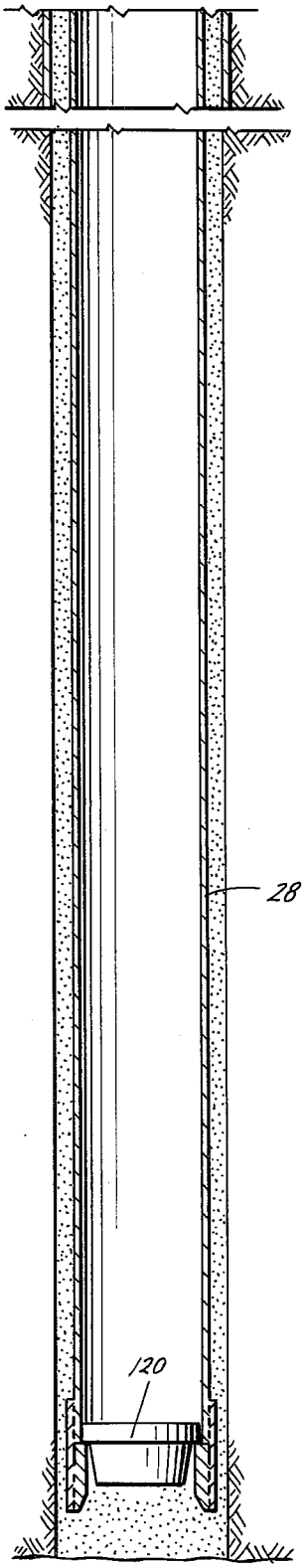
Figure 1E:
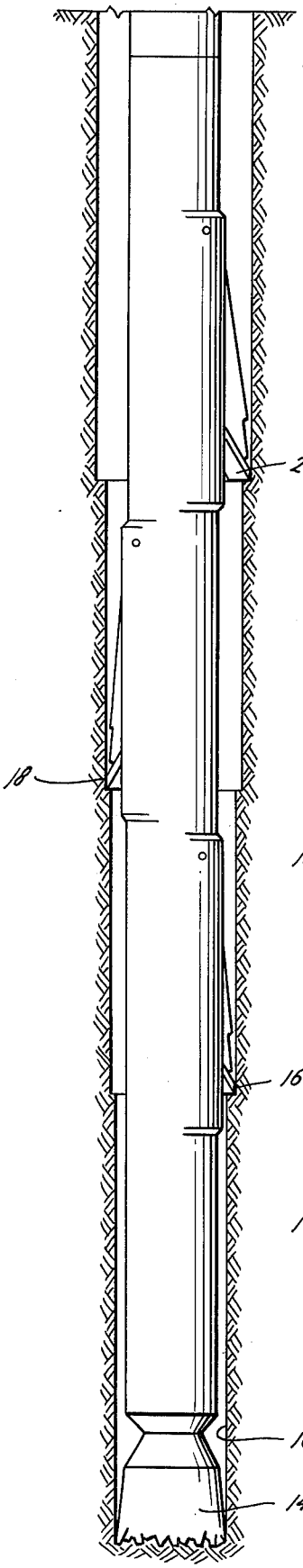

The releasable connection between the body 76 and liner 28 is provided by the pin 84 secured in the liner 28 and extending into engagement in the H-shaped slot 86 in the body 76. This type of connecting means is commonly referred to as a pin and J-slot connection. As can be seen in FIG. 1C, one leg 88 of the slot is shorter than the other leg 90 and they have the central opening 91 connecting between the two legs 88 and 90. With the pin 84 in the short leg 88, the body 76 moves with liner 28. The limited length of leg 88 is not sufficient to allow either the upper expander cone 92 or the lower expander cone 94 to move under their respective gripping elements 78 and 80. When it is desired to set the hanger assembly 74, the liner 28 is moved axially one direction to assure the pin 84 is in one end of the short leg 88. Thereafter, the liner 28 is moved axially the distance of one half the length of leg 88 and then rotated to the left to position the pin 84 in the leg 90. Thereafter, the liner 28 is lowered to move the upper cone expander 92 under the upper gripping elements 78 to wedge them into gripping engagement with the interior of casing 12. In this position, the hanger assembly 74 supports the liner 28 within the casing 12 and the drill string 26 may be removed as shown in FIG. 2.

The lower expander cone 94 is provided to assure that a pressure kick which might remove the upper expander cone 92 from under the upper gripping elements 78 would move the lower expander cone 94 under the lower gripping elements 80 to hold the liner 28 in the casing 12 against the pressure which develops in the annulus between the liner 28 and the casing 12.

In operation, drilling and enlargement of the well bore 10 proceeds with the drill string 26 having the drill bit 14 and the three-stage underreamers thereon and the liner 28 supported thereon. This is shown in FIG. 1. When drilling has proceeded to the point where liner 28 is to be cemented, the liner is rotated to the left after centering pin 84 in the leg 88 of slot 86. This moves the pin 84 into the leg 90 to allow the drill string 26 and liner 28 to be lowered, moving expander cone 92 under the gripping elements 78 to set the hanger assembly 74. With the hanger assembly 74 set, rotation of drill string 26 to the right results in unthreading the collet 34 from the threads on the interior of mandrel 44. Thereafter, the drill string 26 is retrieved through the liner 28 which remains in the well bore 10 supported by the hanger assembly 74, This is shown in FIG. 2.

Cementing of the liner 28 in position within the casing 12 is begun by running the cementing string 96. The cementing string 96 includes the sleeve 98 having upper and lower external seals 100 and 102, and the mandrel 104. When run into liner 28, the seal 100 seals against the interior of the mandrel 44 immediately below the threads into which collet 34 engages and the seal 102 seals against the interior of tubular member 42 in the area of the enlargement 52. Between seals 100 and 102, there is provided an annular space 106 which is in communication with check valve 108 at its upper end and with port 110 at its lower end. When shear pin 48 is sheared as hereinafter explained, the relative movement of support tube 42 with respect to collar 46 brings port 110 through tube 42 into registry with port 112 through collar 46. With this communication open during cementing, the cement flowing upward in the annulus around the liner 28 passes inward through ports 110 and 112 upthrough annular space 106 and out through check valve 108 to bypass the sealing cup assembly 70. Check valve 108 is designed to permit flow from the annular space 106 to the annulus surrounding the liner 28 while preventing flow in the opposite direction.

The actuation of the liner 28 for cementing is accomplished by the engagement of ring 116 against the inner shoulder 116 on mandrel 44. When the cementing string 96 exerts a weight on mandrel 44, the pin 48 shears and the mandrel 44 and the tubular member 42 move downward until the lower end of member 42 engages on the shoulder 56 on the interior of liner section 54. Liner section 54 is held against axial movement by the hanger assembly 74. When member 42 bottoms on shoulder 56, the ports 110 and 112 are in registry and the flow of cement is commenced. Cement flows downwardly through cementing string 96, the interior of liner 28 filling the well bore below liner 28. The cement then flows upwardly through the annulus surrounding liner 28, then through ports 110 and 112, the annular space 106 and out check valve 108. In cementing, the plug 120 is pumped down following the cement and seats in the lower end of the liner 28.

The bypass flow of cement around the sealing cup assembly 70 assures that the liner is not lifted sufficiently to unset the hanger assembly 74.

Figure 5:
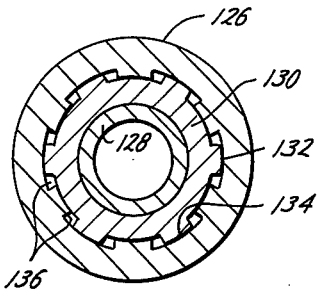
FIG. 5 is a sectional view taken along line 5—5 in FIG. 4A to illustrate the driving connection between the telescoping components of the drilling apparatus.
Figure 6:
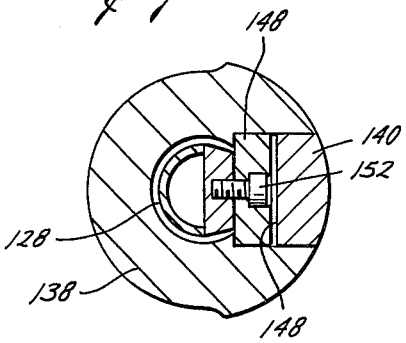
FIG. 6 is another sectional view of the underreamer taken along line 6—6 in FIG. 4D.
Figure 7:
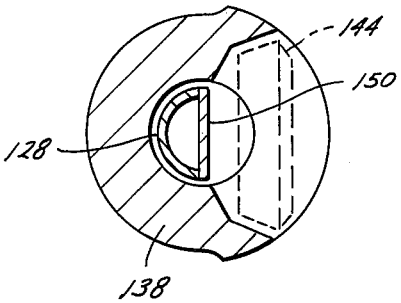
FIG. 7 is still another sectional view of the underreamer reamer taken along line 7—7 in FIG. 4D.

The drilling apparatus including the drill bit 14 and the three-stage underreamers 16, 18, and 20 are disclosed in greater detail in FIGS. 4, 5, 6 and 7. In FIGS. 4A and 4B, the upper end of the drilling apparatus is shown including the connection to the mud motor 21 and the telescoping joint 122. The joint 122 includes the sub 124, the outer tubular member 126, the inner mandrel 128 and the sleeve 130. The sleeve 130 is slidable axially relative to and in the space between tubular member 126 and mandrel 128. As shown in FIG. 5, the sleeve 130 is provided with splines 132 which engage within the grooves 134 in outer tubular member 126. Each of the splines 132 is protected by the wear inserts 136 positioned on both sides of the splines 132, as shown.

The body 138 of the underreamers is connected to the lower end of sleeve 130 and inner mandrel 128 extends downwardly through the interior of body 138. Each of the underreamers 16, 18 and 20 have substantially the same structure except that they extend outward to varying diameters so that the well bore is progressively enlarged by the underreamers.

Figures 4B, 4C, 4D:
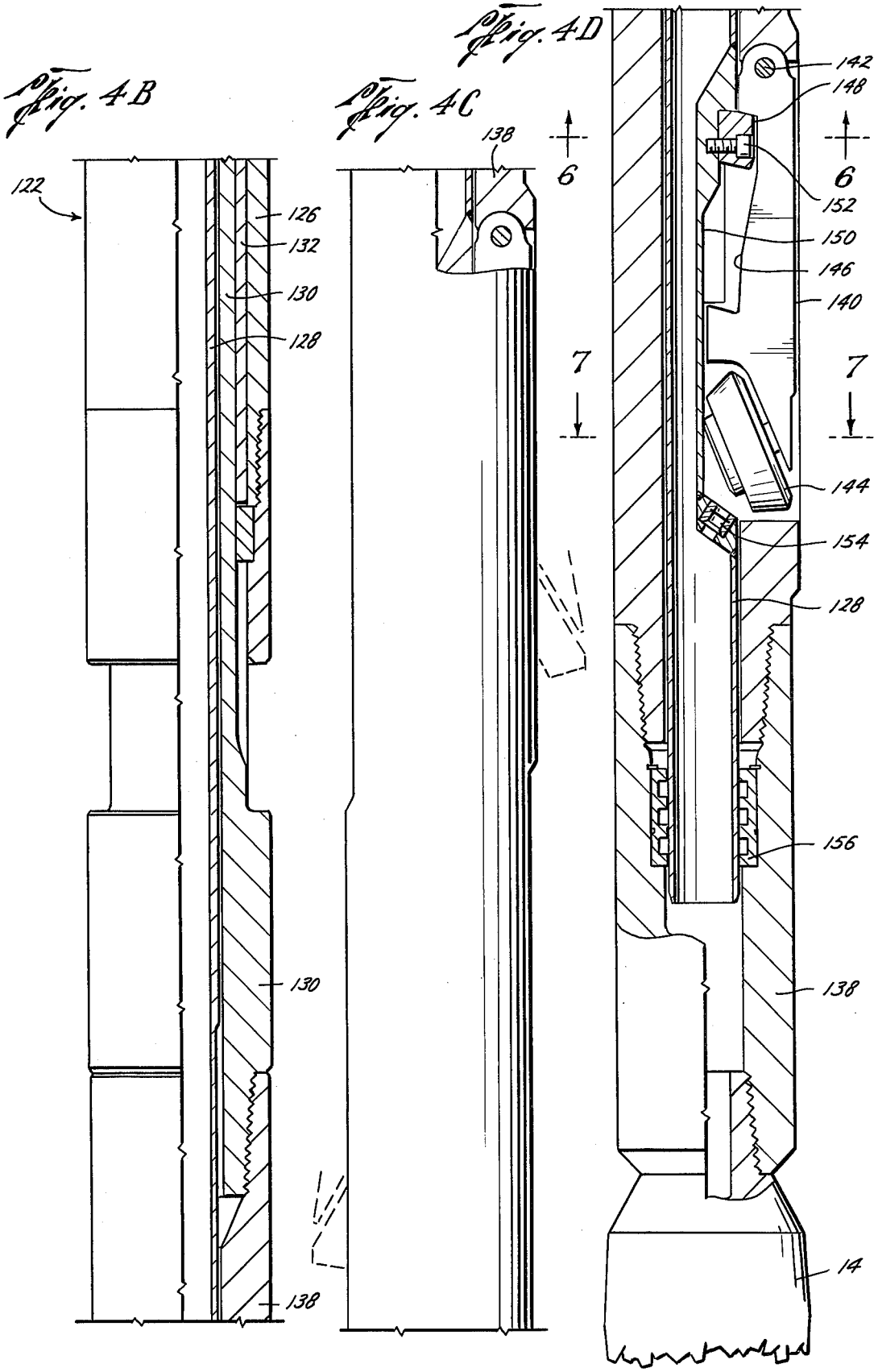

Each of the underreamers, as best seen from FIG. 4D, includes an arm 140 which is pivotally mounted to the body 138 by the pin 142 and includes a roller cutter 144 mounted on the outer end of the arm 140. The inner surface of arm 140 has a cam surface 146 which coacts with block 148 attached in the offset portion 150 of the inner mandrel 128. The screw 152 secures the block 148 in position. The lower end of the offset portion 150 includes the port 154 through which drilling fluid is directed into the space around body 138 to assist in the removal of the formation material removed by the underreamer. If desired, the port 154 includes a hardened insert to minimize wear of the drilling fluid passing therethrough.

The lower end of inner mandrel 128 extends downward through seal 156 which is mounted in body 138 and seals between the exterior of mandrel 128 and the interior of body 138.

The drilling apparatus is lowered through the casing 12 with the liner 28 suspended from the drill string 26. The drilling apparatus with the underreamers retracted easily passes through the liner 28. In running, the underreamers 16, 18 and 20 are withdrawn within the body recesses. When in drilling position, the liner 28 terminates above the upper underreamer 20. When the drill bit 14 sets on the bottom of the well bore 10, the weight of the string above the drilling assembly causes the inner mandrel 128 to move downward with respect to sleeve 130. This movement forces the blocks 148 downward against the cam surfaces 146 wedging the lower ends of the arms 140 outward to move the cutter 144 to its underreaming position. Circulation of drilling fluid through the motor 21 rotates the drilling apparatus to drill additional well bore.

What is claimed is:

1. A well tool comprising a drill string, a drill bit and a plurality of underreamers secured to the lower end of said drill string, a liner, means for releasably connecting the liner to said drill string, a gripping assembly, said gripping assembly being slidably mounted in surrounding relation to said liner and having two sets of gripping elements, said liner having an external taper adapted to coact with the gripping elements of said gripping assembly whereby relative movement between said liner and said gripping assembly wedges one set of said gripping elements into gripping engagement with the wall of the well bore, said liner including means for sealing between the exterior of the liner and the interior of a well casing into which said liner is run, means connecting said gripping assembly to said liner and including means responsive to manipulation of said liner to limit or allow axial movement of said liner through said gripping assembly, and means associated with said gripping assembly resisting axial movement through a wall bore.

2. A well tool according to claim 1 wherein said liner and said seal means define bypass passage internally around said seal means whereby when said seal means are in sealing engagement with the well casing flow of fluids may bypass around the sealed annulus to allow easy flow of cement into the well.

3. A well tool according to claim 2 including a check valve in said bypass passage allowing flow of fluids upward through said passage and preventing flow of fluids downward through said passage, means closing said passage to confine the fluids in the annulus below said sealing means and operable to open said passage, and means for releasably retaining said closing means in closed position and operable responsive to manipulation of a string.

4. A well tool according to claim 1 wherein said liner has a pair of external tapered surfaces one of which diverges upward and coacts with one set of said gripping elements to support the weight of said liner and the other tapered surface diverges downward and coacts with the other set of said gripping elements to resist upward force on said liner, said tapered surfaces on said liner being spaced apart a distance greater than the distance between said sets of gripping elements whereby said liner moves a short distance when the liner load is transferred between sets of gripping elements.

5. A well tool according to claim 1 including a normally closed bypass passage through a portion of said liner around said sealing means, said bypass passage being opened by relative movement of portions of said liner whereby cement may be placed around all portions of the exterior of said liner except said sealing means.

6. The method of drilling a well bore and setting a liner therein including the steps of connecting a drill string to a drill bit on the lower end thereof and to a liner having a gripping assembly therearound, lowering said drill string, said drill bit and said liner into a well bore, rotating said drill bit to deepen said well bore and lowering said drill string as drilling progresses, manipulating said drill string to set said gripping assembly within said well bore which supports said liner within said well bore, disconnecting said drill string from said liner, recovering said drill string from said well bore, lowering a cementing string into said well bore into sealed engagement within said liner, pumping cement through said cementing string and upwardly around the exterior of said liner, and removing said cementing string from said well bore.

7. The method according to claim 6 wherein sealing means surround said liner and coact therewith to define a normally closed bypass passage including the step of manipulating said liner to open said bypass passage before said step of pumping cement through the cementing string.

8. A well tool comprising a liner, means for connecting said liner to a string for lowering into a well bore casing, a gripping assembly, said gripping assembly being slidably mounted in surrounding relation to said liner, said liner having an external taper adapted to coact with the gripping elements of said gripping assembly whereby relative movement between said liner and said gripping assembly wedges said gripping elements into gripping engagement with the wall of the well casing, means on said liner for sealing between the exterior of said liner and the wall of the well casing into which the liner is run, means for connecting said gripping assembly to said liner and including means responsive to manipulation of said liner to limit or allow axial movement of said liner through said gripping assembly, and means associated with said gripping assembly resisting axial movement through a well bore, said gripping assembly and said sealing means when set coacting to retain said liner in its set position within the well casing against both upward and downward forces, said liner has a pair of external tapered surfaces one of which diverges upward and coacts with one set of said gripping elements to support the weight of said liner and the other tapered surface diverges downward and coacts with the other set of said gripping elements to resist upward force on said liner, said tapered surfaces on said liner being spaced apart a distance greater than the distance between said sets of gripping elements whereby said liner moves a short distance when the liner load is transferred between sets of gripping elements.

9. A well tool comprising a drill string, a drill bit and a plurality of underreamers secured to the lower end of said drill string, a liner, means for releasably connecting the liner to said drill string, a gripping assembly, said gripping assembly being slidably mounted in surrounding relation to said liner, said liner having an external taper adapted to coact with the gripping elements of said gripping assembly whereby relative movement between said liner and said gripping assembly wedges said gripping elements into gripping engagement with the wall of the well bore, means connecting said gripping assembly to said liner and including means responsive to manipulation of said liner to limit or allow axial movement of said liner through said gripping assembly, and means associated with said gripping assembly resisting axial movement through a well bore.

* * * * *